United States Patent [19]

Goldman

[11] 4,359,885

[45] Nov. 23, 1982

[54] KEY-OPERATED LOCKS

[76] Inventor: Ilan Goldman, 10 Bar-Eli St., Tel-Aviv, Israel

[21] Appl. No.: 105,904

[22] Filed: Dec. 21, 1979

[30] Foreign Application Priority Data

Dec. 28, 1978 [IL] Israel ..... 56335

[51] Int. Cl.[3] ..... E05B 21/00; E05B 25/00

[52] U.S. Cl. ..... 70/355; 70/382

[58] Field of Search ..... 70/302, 303 R, 303 A, 70/323, 326, 327, 328, 355, 365, 366, 382, 383, 384, DIG. 28

[56] References Cited

U.S. PATENT DOCUMENTS 2,301,755 11/1942 Seiffert ..... 70/355

3,991,596 11/1976 Gartner ..... 70/303 A

FOREIGN PATENT DOCUMENTS 147928 11/1954 Sweden ..... 70/382

*Primary Examiner*—Robert L. Wolfe

*Attorney, Agent, or Firm*—Ostrolenk, Faber, Gerb & Soffen

[57] ABSTRACT

A lock particularly for safe doors, of the multiple rotatable tumbler type, but adapted to be operated by a key, the "combination" of the lock being set by the key proper and being alterable at will by changing the relative arrangement of its bits.

A key with changeable bits for use with the said lock is also described.

22 Claims, 49 Drawing Figures

10
26
12
30
94
34
31
28
24
96
26
104
18
92
32
22
100
102
98
30
28
36
96
N1
38
14
60
P1
58
40
26
52
N3
T1
01
50
N2
42
56
P2
64
P3
76
54
72
62
44
T3
03
70
T2
02
46
70
78
29
80
48
74
29
82
16

88
90

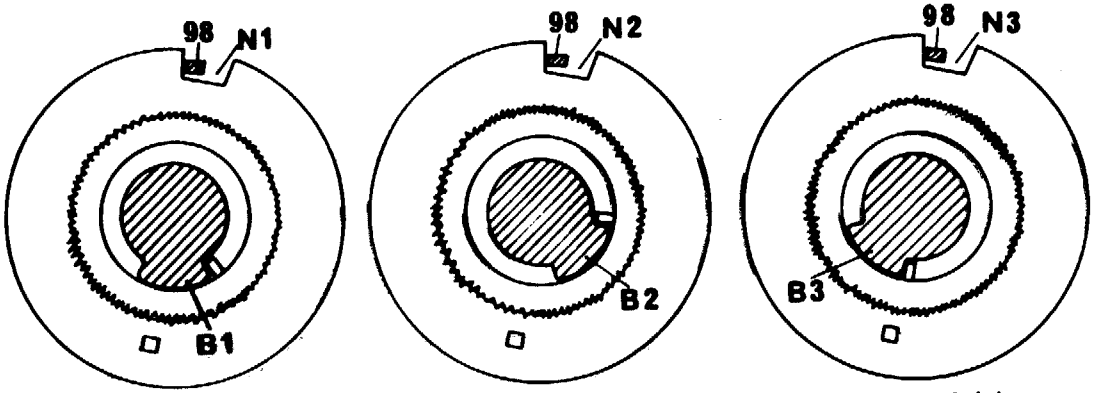
Fig.12 (a)
Fig.12 (b)
Fig.12 (c)
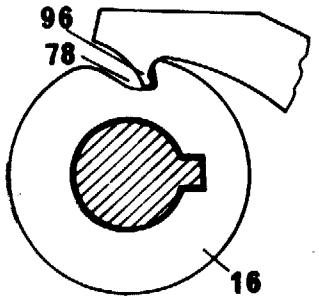
Fig.12(d)
Fig.12
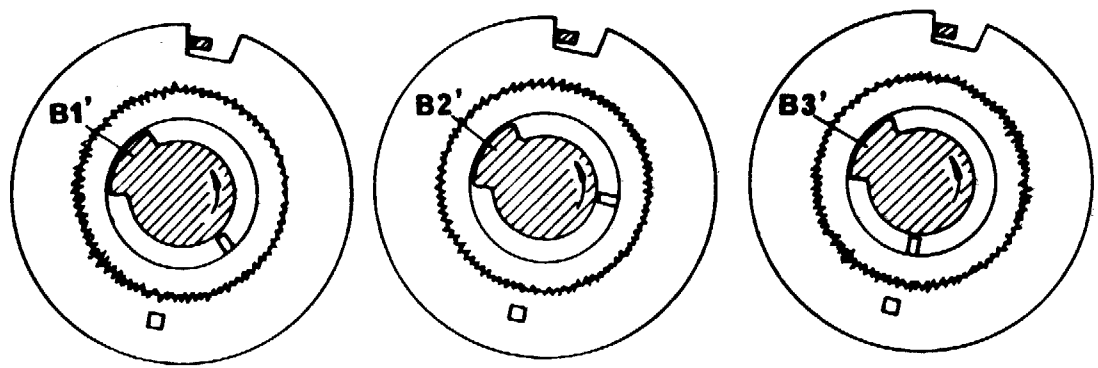
Fig.13 (a)
Fig.13(b)
Fig.13 (c)
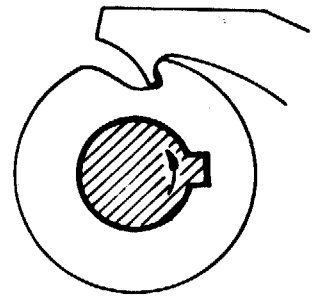
Fig.13 (d)
Fig.13

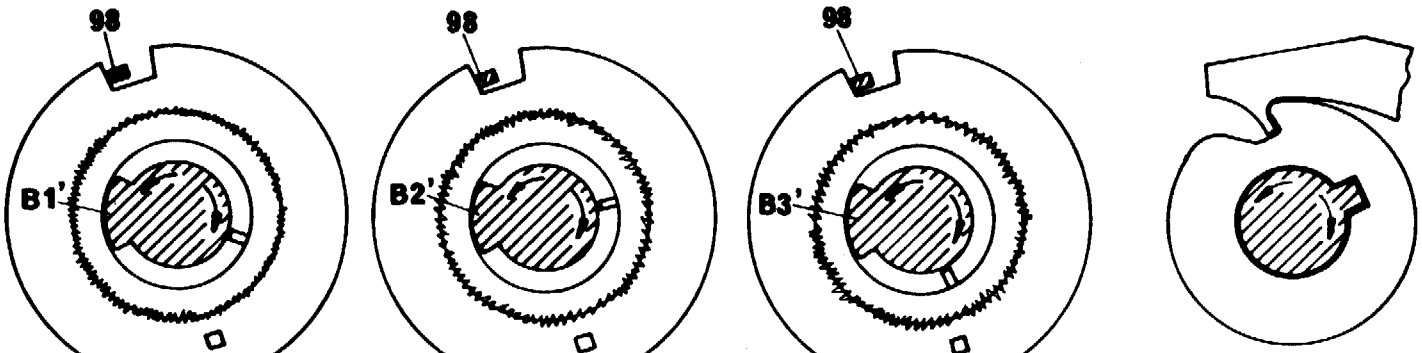
Fig. 14 (a)
Fig. 14 (b)
Fig. 14 (c)
Fig. 14 (d)
Fig. 14
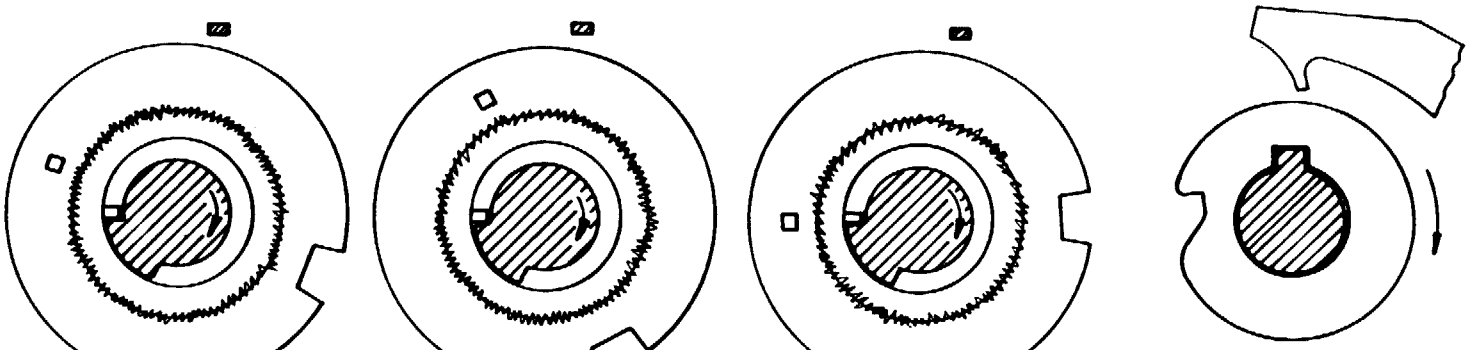
Fig. 15 (a)
Fig. 15 (b)
Fig. 15 (c)
Fig. 15 (d)
Fig. 15

KEY-OPERATED LOCKS

The present invention relates to key-operated locks, which may descriptively be defined as key-type dial combination locks.

Dial combination locks are widely used in safes and the like, and need not be described in detail. It will be noted, however, that combination locks inherently suffer from the following main drawbacks: First, the use of the combination lock is quite cumbersome in the respect that each time, a two-digit number has to be dialed three times, in opposite directions, and in a most accurate way before the lock can be opened. This multistaged opening operation procedure becomes a nuisance if frequent locking and unlocking is to be performed. Therefore, risky as it is, safes or other combination-lock operated doors are usually opened only once, (say, at the beginning of the working day) and left open for the rest of the day.

Secondly, once the combination numbers are disclosed or otherwise made known to another party, there always exists the risk that such other party will use this information for his own benefit. To remedy this situation, it is always possible to change the combination of the lock. This operation, however, is also quite involved and calls for special skill and experience.

Key-operated locks are quickly and easily operated, and are more reliable in the sense that only the key-holder can open the door. He may lend the key to another person, but, for as-long-as the other person does not copy the key, the owner can be assured that nobody else would open the lock without authorization.

On the other hand, however, the "combination" of the key (namely, the specific arrangement of the key bits) is fixed, and cannot be altered at will the same way as the dial-combination locks are.

It is the general object of the invention to provide a key-operated lock wherein the arrangement of the operating members of the key and lock can be changed at any time, to avoid the hazard of somebody having been able to copy the key.

It is a further object of the invention to provide a key-operated lock following the general constructional features of the common, known dial-combination locks.

According to a first aspect of the invention there is provided a key-operated lock for safe doors and the like comprising a housing; a lock-bolt operable between an unlocked, withdrawn position and a locked, projected position; a lever coupled at one end thereof to the lock-bolt and provided at its other end with an extended control member and with engaging means; a rotatable lever-operating member; a plurality of indexable tumblers mounted in axial alignment with respect to each other, the tumblers being indexable by a key to assume a pre-determined relative position with respect to each other and to said control member; said lever being displaceable between operative and non-operative positions controlled by said control member and said tumblers, the arrangement being such that in said operative position, the said tumblers are in said pre-determined relative position and said engaging means are coupled to said lever operating member.

According to another aspect of the invention there is provided a key for operating the said lock comprising a shank provided with a plurality of radially projecting, axially spaced bit members, which members are releasably mounted on the shank.

In a preferred embodiment of the key, the bits are attached to rings, the rings being slidably received on a stem having a polygonal cross-section for mounting thereof at various angular positions with respect to each other. There may be provided a first set of bits for effecting the said indexing of the tumblers into said pre-determined position thereof, and a second set of bits for returning the tumblers into their initial positions.

These and further constructional features and advantages of the present invention will become apparent from the ensuing description, given by way of a non-limitative example only, with reference to the accompanying drawings, wherein FIG. 1 is a schematic, rear-side three-dimensional exploded view of the lock-housing and associated parts;

Figures 8, 8E, 8G, 8H, 8I, 8J, 8K, 8L:
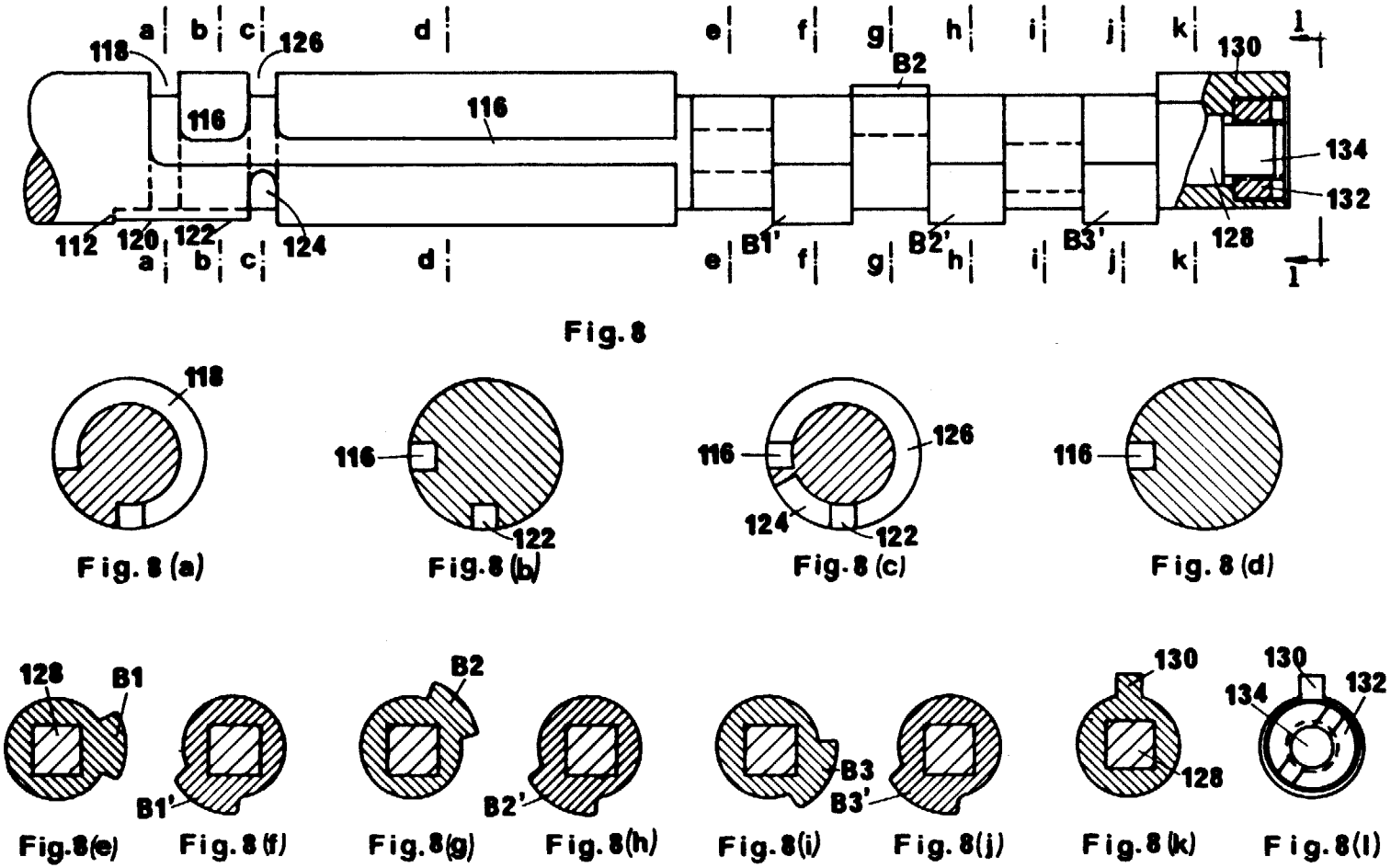
FIG. 8 is an elevation of the key shown in FIG. 7.
Figure 9:
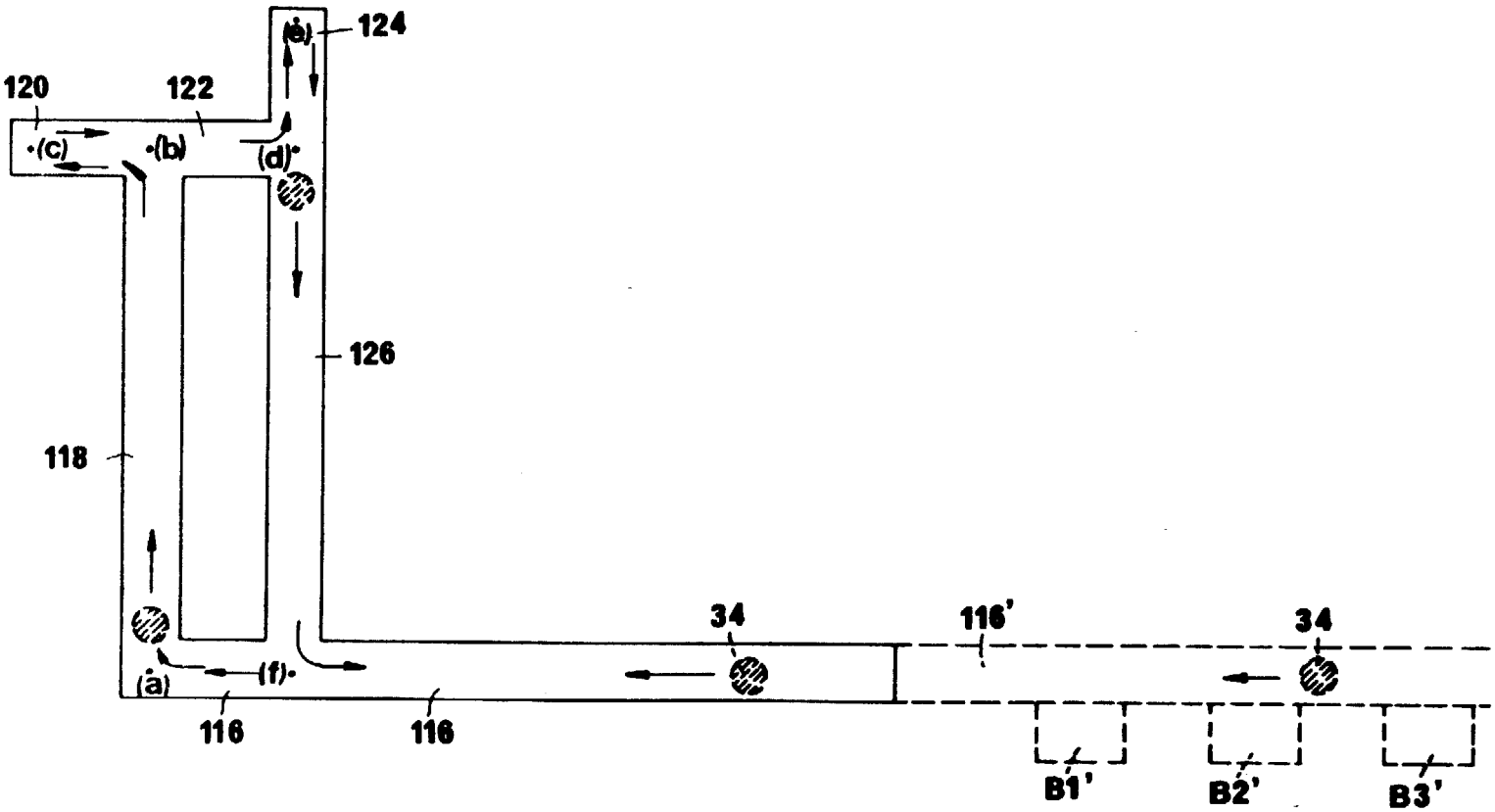
Figure 10:
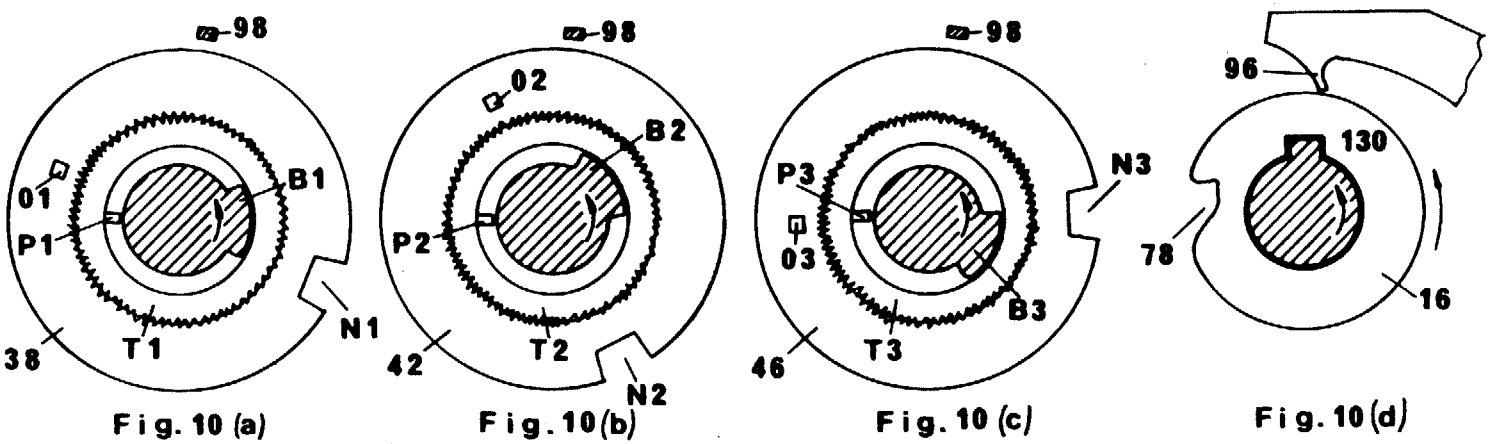
Figure 11:
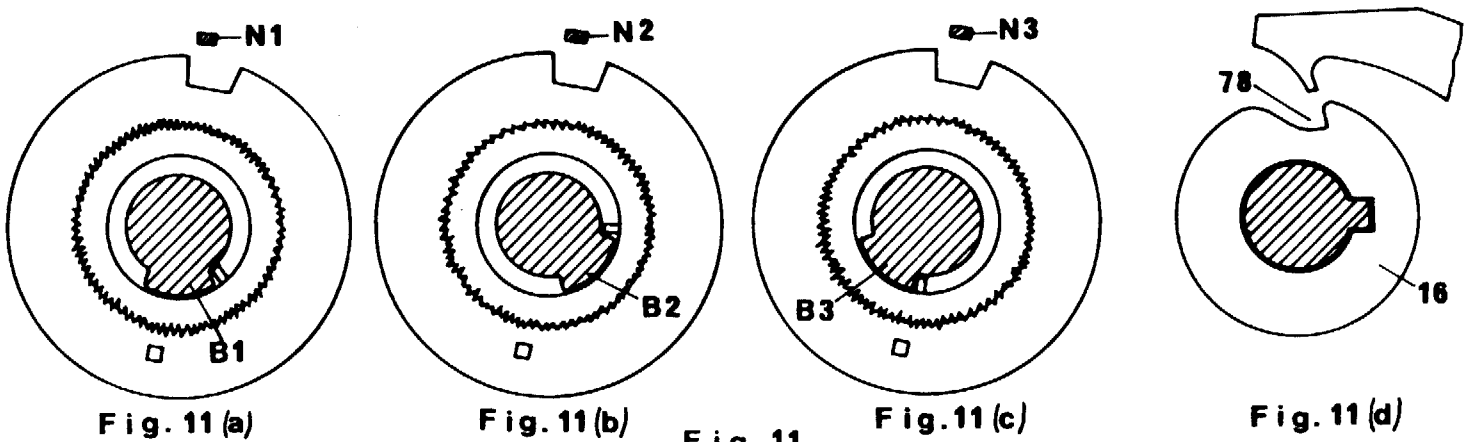
Figures 16, 16D:
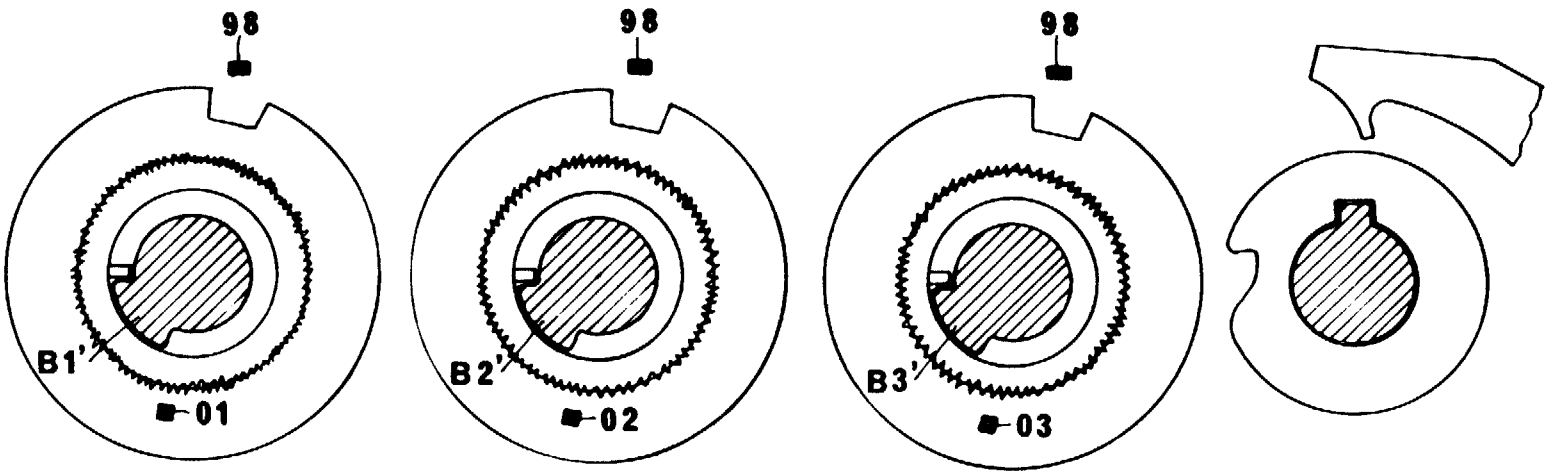

FIGS. 8(*a*) through 8(*l*) are cross-sections along lines a—a through l—l of FIG. 8, respectively;

FIG. 9 is a spreaded-view of the guide-slots of the key;

FIGS. 10(*a*) through 10(*d*) illustrate a first step of operating the lock;

FIGS. 11(*a*) through 11(*d*) illustrate a second step of operating the lock;

FIGS. 12(*a*) through 12(*d*) illustrate a third step of operating the lock;

FIGS. 13(*a*) to 13(*d*) illustrate a fourth step of operating the lock;

FIGS. 14(*a*) to 14(*d*) illustrate a fifth step of operating the lock;

FIGS. 15(*a*) to 15(*d*) illustrate a final step of operating the lock;

FIGS. 16(*a*) to 16(*d*) illustrate a step of changing the combination of the lock.

Figure 6:
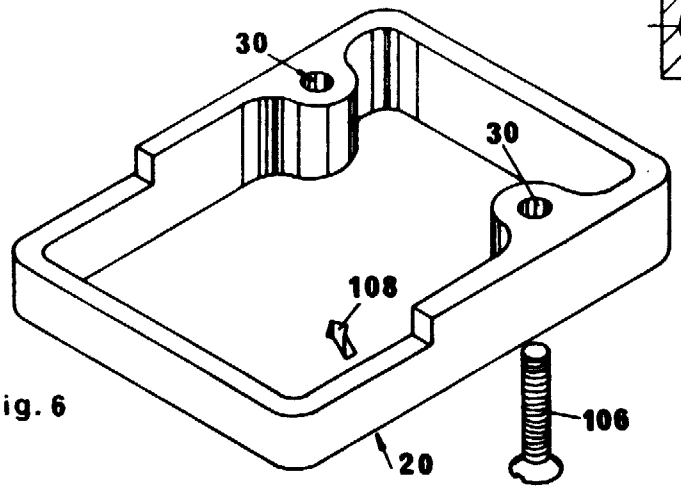
FIG. 6 is a three-dimensional view of the lock-housing cover.

Referring now to FIGS. 1 to 6, there is shown a lock featuring the principles of the present invention, comprising a housing generally indicated 10, a reciprocable lock-bolt 12, indexable tumbler-discs-assembly generally indicated 14, a lever operator notched disc 16, a displaceable spring-urged lever 18, and a cover plate 20 (FIG. 6).

The housing 10 is essentially a solid metal block provided with a cylindrical cavity 22 constituting a housing for the tumblers assembly 14. It further comprises a cavity 24 for the slidable movement of the lock-bolt 12; bores 26 for mounting the lock onto a door (not shown); tapped bores 28 for the assembly of the tumblers system by screws 29; tapped bores 30 for mounting the cover 20 (FIG. 6) after the assembly of the lock; and a projection 31 the function of which will be described further below.

The front side of cavity 22 is provided with keyhole 32 (see FIG. 3) provided with a fixed guiding pin 34 for guiding the key through the various operational phases thereof, as will be described in detail below.

The tumbler discs assembly 14 comprises the following members in the order of their assembly within the cavity 22: a springy washer 36; a first tumbler disc 38; a fixed spacer plate 40; a second tumbler dis 42; a second spacer plate 44; a third tumbler disc 46; a fixed cover plate 48; and the lever operator disc 16. All the members are axially aligned in register with the axis of the cavity 22.

As known in the combination-locks art, each tumbler disc 38, 42 and 46 is composed of a central portion T1, T2 and T3 respectively, which is separable from the encircling portions by a friction clutch means operable by a special tool insertable through openings 01, 02 and 03, respectively. Central portions T1, T2 and T3 are each provided with an annular flange F1, F2 and F3 (See FIG. 3), and with inwardly radially directed tumbler pins P1, P2 and P3. The peripheral circumference of discs 38, 42 and 46 is provided with a recess or notch N1, N2 and N3.

Spacer plates 40 and 44 are identical, each provided with central openings 50, 52, openings 54 and 56 in register with openings 01 and 02 for the insertion of the clutch operating tool, upper cut-away segmental edges 58 and 60, and notches 62 and 64 cooperating with pins 66 and 68 (FIG. 3) fixed at the wall of cavity 22 for preventing the rotation of the plates 40 and 44.

Cover plate 48 is provided with bores 70 for the screws 29; annular projecting flange 72; opening 74 for the clutch tool; and a segmental edge 76.

Operator disc 16 has a notch 78 at its peripheral circumference, a central key-way 80 and a projecting roller 82 whose function will be described further below. Disc 16 is rotatably supported on flange 72 of plate 48, as shown in FIGS. 3 and 4, by a circular slot 84.

Figure 3:
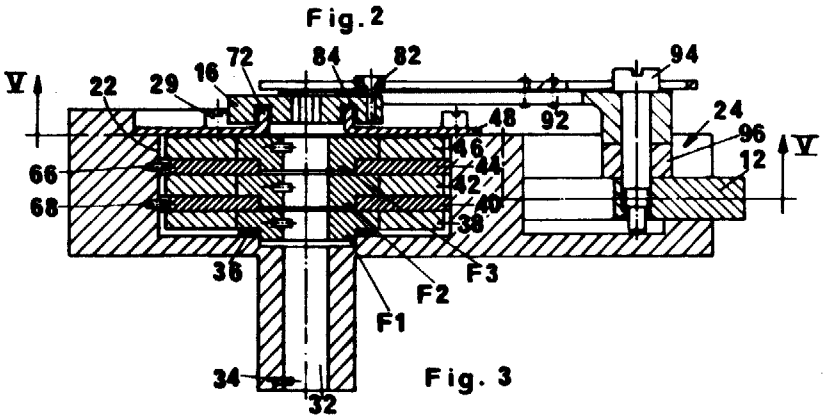
FIG. 3 is a cross-section along lines III—III of FIG. 2.
Figure 4:
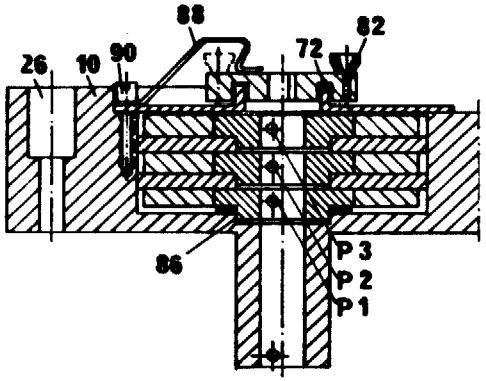
FIG. 4 is a cross-section along lines IV—IV of FIG. 2.
Figure 5:
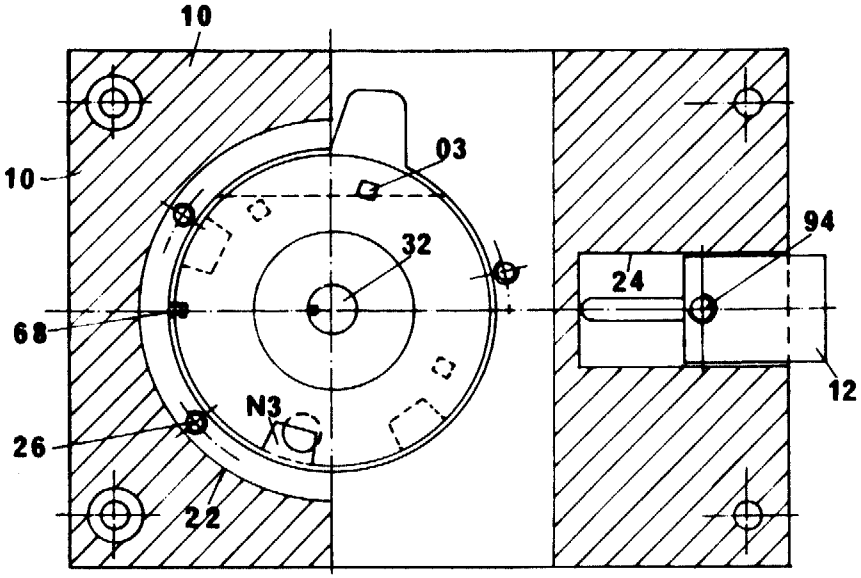
FIG. 5 is a cross-section along line V—V of FIG. 3.

It can thus be seen from FIGS. 3 and 4 that the tumbler discs assembly 14 is compactly installed within cavity 22 of the housing 10 by having the flange F1 fitting into a circular recess 86 (FIG. 4) formed at the front wall of the cavity 22, flange F2 rotatably supported within opening 50 of spacer 40, and flange F3 supported within opening 52 of spacer 44; each of the tumbler discs 38, 42 and 46 is allowed to rotate against the friction of its supporting spacers compressed by the springy washer 36.

Operator disc 16 is allowed to move a small distance in the axial direction against the force of a curved leaf spring 88 fixed by screw 90 to the housing 10 at its one end, and frictionally pressing by its other end against the outer wall of the disc 16, at a location around the key-way 80, without, however, interfering with the rotation of the disc, i.e. allowing the roller 82 to pass thereunder, as shown in FIG. 4.

The construction and assembly of the lever unit 18 will be now only briefly discussed, since it is nearly the same as in dial-combination locks well known in the art. Lever 92 is pivotally connected to lock-bolt 12 by a screw 94 passing through a bushing 95. The free end of the lever 92 is provided with a hook-like portion 96 adapted to engage notch 78 of disc 16 when lever position control member 98 is free to enter all of the notches N1, N2 and N3, that is, after the indexing of the tumblers 38, 42 and 46 into their properly aligned operative positions.

There are further provided a specially designed spring member 100 having an extension 102 engageable by protrusion 31 of the lock housing; and a wire-spring 104 regulating the non-operative and operative positions of the lever 92 with respect to an intermediate dead-center position. (The function of springs 100 and 104 is to prevent the downwards movement of the lever 92 unless all notches N1, N2 and N3 are aligned under-side control member 98, all in a manner which is known in the art, does not form a part of the invention and therefore need not be described in more detail.)

After the assembly of all the parts and components as afore described, the housing 10 is closed by the cover 20 shown in FIG. 6, using screws 106 and tapped bores 30. A suitable opening 108 is provided at the cover 20 through which the clutch tool would be inserted for changing the relative positions of the inner and outer portions of each tumbler disc, as described below.

Figure 7:
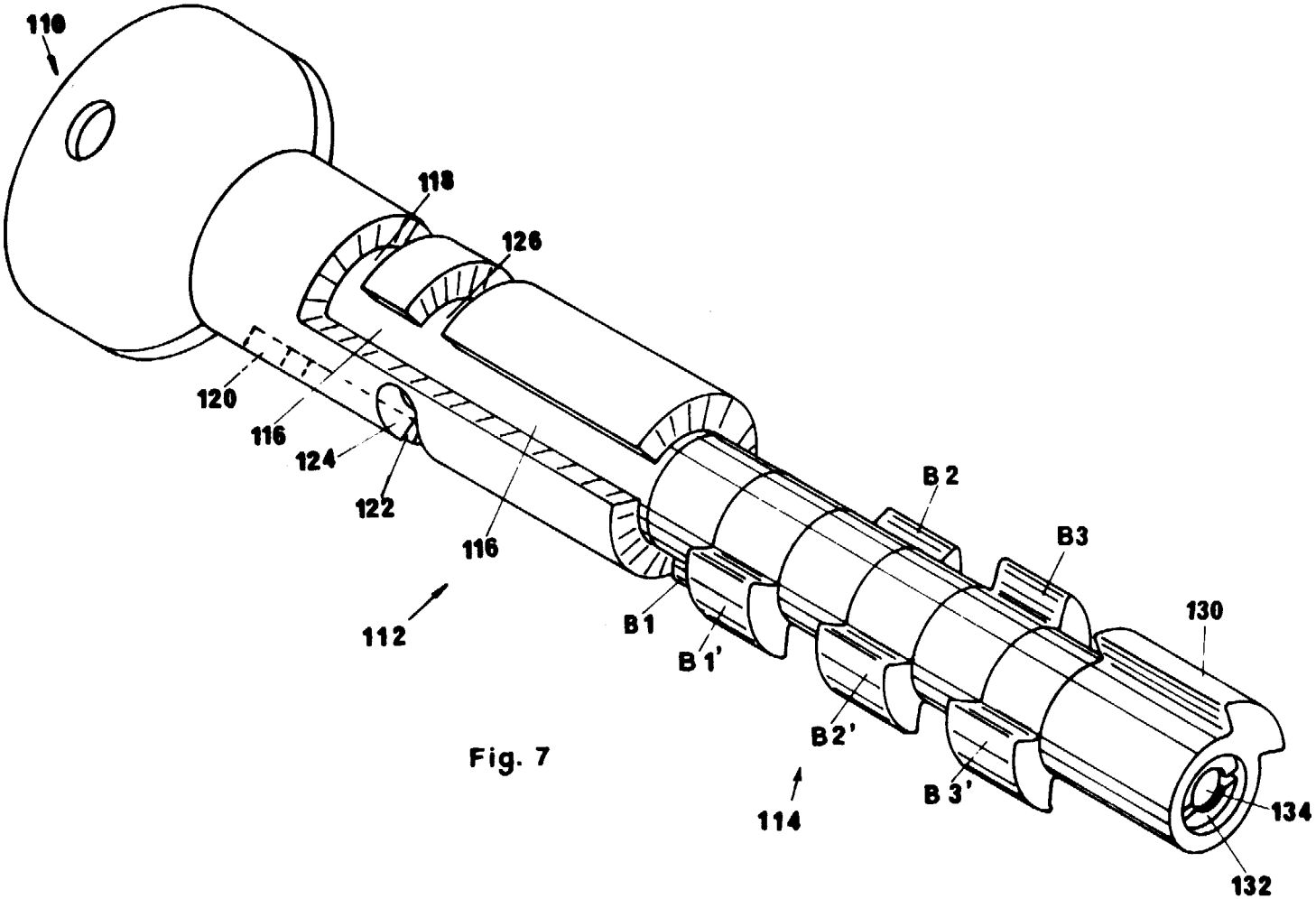
FIG. 7 is a three-dimensional view of a key for operating the lock of FIGS. 1–7.

In FIGS. 7 and 8 there is shown a preferred embodiment of a key generally indicated 110, for operating the lock heretofore described. The key comprises a head portion, a trailing shank-portion generally indicated 112, and a leading shank-portion indicated 114. The shank portion 112 comprises a network of guiding slots, the layout thereof being spreadly shown in FIG. 9. It comprises a first axial slot 116, a first circular slot 118 extending along about three-quarters of the circumference of the shank (see FIG. 8(*a*)), a second axial slot 120 extending a short distance in the direction of the slot 116, a third axial slot 122 extending in the opposite direction with respect to and in line with slot 120, a third-circular slot 124 extending in the direction of slot 118 (see FIG. 8(*c*)) and a fourth circular slot 126 extending alongside of and parallel to slot 118.

The key further comprises two sets of bits designated B1, B2, B3 and B1', B2' and B3'. It will be noted that bits B1, B2 and B3—which are referred to as "the changeable bits"—are spread around the axis of the key, while bits B1', B2' and B3'—"the fixed bits"—are arranged in alignment with each other i.e. having the same radial position with respect to the axis of the key. All bits are slidably received on a square stem 128 forming an extension of the shank 112.

Figure 1:
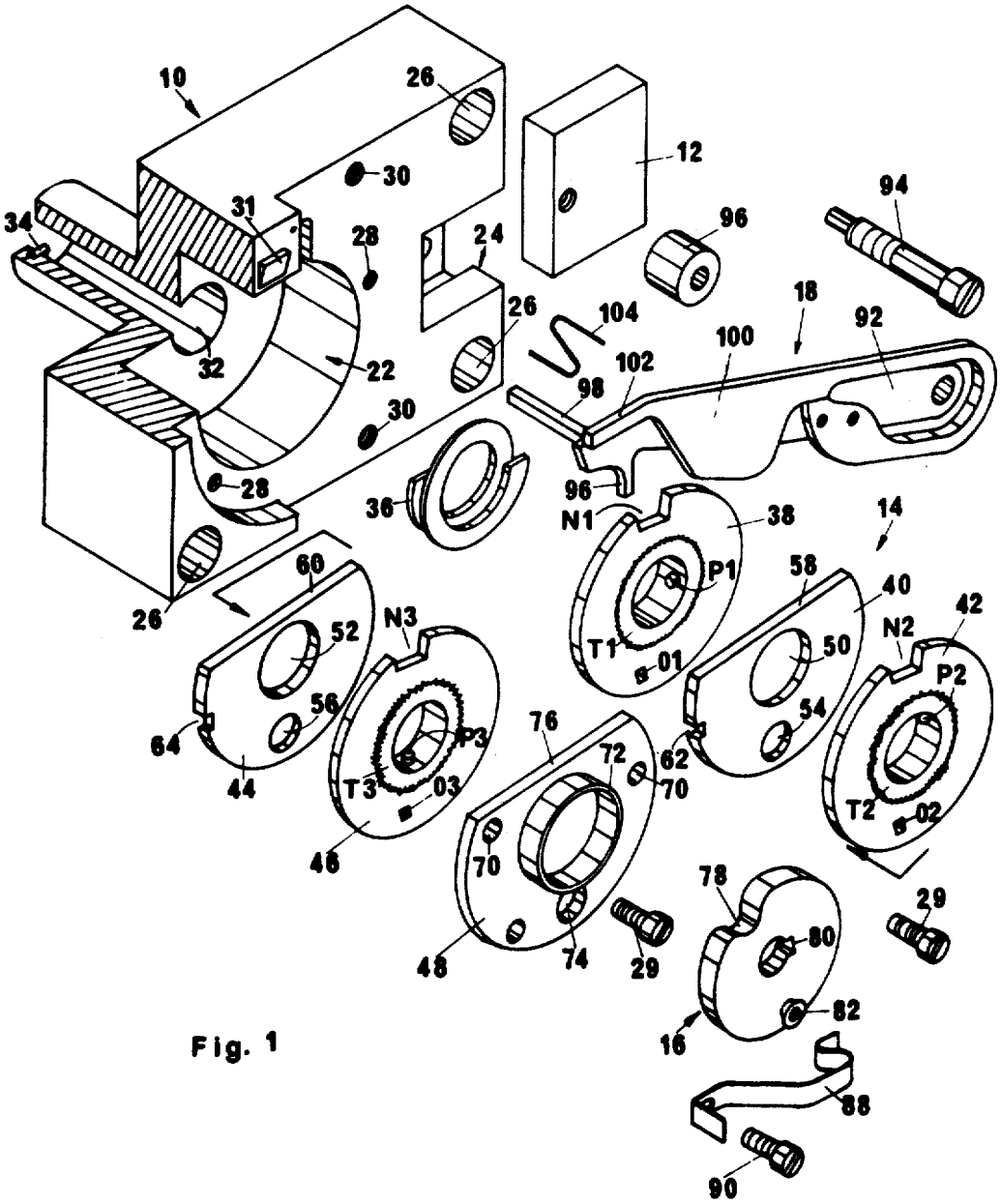
Figure 2:
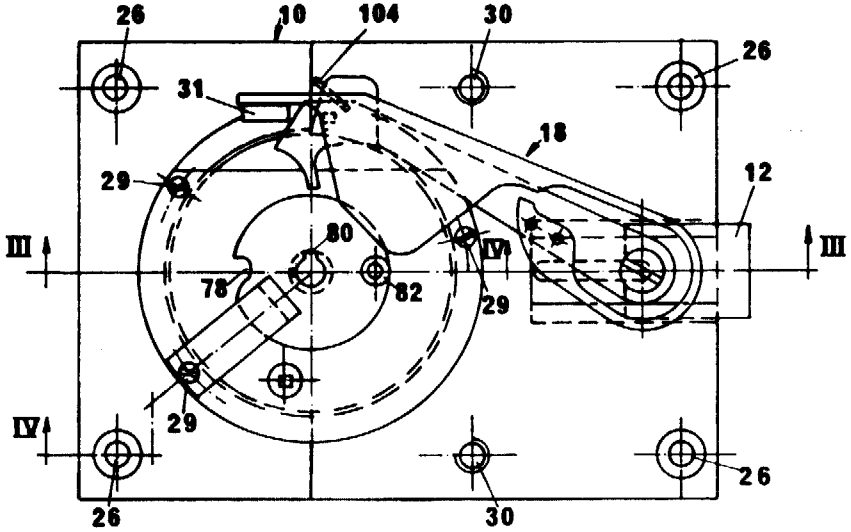
FIG. 2 is an elevation of the lock of FIG. 1.

At the leading end of the key there is provided an elongated projection 130 extending down to the end of the key, and fitting the key-way 80 of disc 16 (see FIG. 1). A tightening nut 132 is provided, threaded on the front end 134 of the stem 128 for tightening together the bits system and the projection 130 received on the stem 128.

It will be noted from FIGS. 8 and 9 that a space 116' is maintained, defined by the (imaginary) extension of slot 116, overlying, though not occupied by any of the changeable and fixed bits and the projection 130, so that any of these protruding elements would not obstruct or interfer with the straight axial insertion of the key past the fixed guiding pin 34. It would be therefore convenient to arrange the fixed bits B1', B2' and B3' in alignment so that one edge thereof would border on one side of said imaginary extension 116', as shown by broken lines in FIG. 9.

The operation of the lock by the key heretofore described will now be explained with reference to FIGS. 9 to 15. Let us assume that at the beginning of the operation the relative positions of tumblers 38, 42 and 46, as-well-as operator disc 16, and the relative positions of bits B1, B2 and B3 are as shown in FIGS. 10(*a*) through 10(*d*).

Hence, notches N1, N2 and N3 are located at different angular positions (in this example, at 4 o'clock, 5 o'clock and 3 o'clock positions, respectively). The tumbler pins P1, P2 and P3 are aligned and placed at the 9 o'clock position. Bits B1, B2 and B3 are also arranged at different annular positions (provided they do not interfere with the imaginary slot 116'), namely, B1 at the 3 o'clock position, B2 at the 2 o'clock position and B3 at the 4 o'clock position. Bits B1', B2' and B3' are all located at the 7 o'clock position, as shown in FIGS. 8(*f*), 8(*h*) and 8(*j*).

The first step would be to insert the key into keyhole 32 until guide pin 34 reaches the crossing of slots 116 and 118 (the point marked (a) in FIG. 9).

Now, turning the key in the counter-clockwise direction by three-quarters of a revolution will cause, successively, the indexing of pins P2 by bit B2, P1 by B1 and P3 by B3, to assume the positions shown in FIGS. 11(*b*), 11(*a*) and 11(*c*) respectively. The initial positions of notches N relative to their respective pins has been pre-set so that in the achieved position of FIG. 11, all notches N will become aligned with respect to each other and located underside the control member 98 of lever 92 (FIG. 1). During this operation, the fixed guide pin 34 would travel along guide slot 118 from the intersection with slot 116, namely, from point (a), to point (b). At the same time, operator disc 16 would be rotated by the projection 130 so that the notch 78 would become located underneath hook 96 of lever 92. FIG. 11 therefore corresponds to the "ready-to-open" position of the known dial-combination lock devices, namely, after the proper dialing of all three combination numbers. Again as in some known types of dial-combination locks, it is now required to push the operator disc 16 rearwardly so that lever 18 would be displaced and its extended member 102 released from the projection 31 (FIG. 1). This will cause the lever 92 to jump downward under the tension of spring 100, overcoming the dead-center point of wire spring 104 (as known, should the tumbler disc notches be not in exact alignment, the lever 92 would jump back into a suspended position above the dead-center point of wire spring 104).

Hence, the operator of the lock would insert the key further, against the force of the leaf spring 88 so that bit B3', which is located immediately behind projection 130, will dislocate the disc 16 to release the lever 92 as above described. This further insertion of the key is facilitated by the guide slot 120 (FIG. 9), while the pin 34 travels from point (b) to point (c).

Eventually, this operation will bring about the position illustrated in FIG. 12, wherein hook member 96 is engaged within notch 78 of disc 16, and control member 98 received within notches N1, N2 and N3.

The actual opening of the lock, namely the withdrawal of lock-bolt 12, will now be effected by pulling the key out (from point (c) to point (d)) and rotating the same further in the counter-clockwise direction along the guide slot 124, to point (e). It will be noted that the transfer of the key from point (b) to point (d) would cause the bits B1', B2' and B3' to become aligned with the tumbler pins P1, P2 and P3, which were formerly engaged by bits B1, B2 and B3. This transposition of changeable bits B and fixed bits B' is represented in FIG. 13.

FIG. 14 shows that such further rotation of the key along guide slot 124 from point (d) to point (e), while lever 92 is engaged by disc 16, would cause all tumblers to follow-suit and rotate without, however, changing their aligned arrangement. This is due to the transmission of the lever movement through the control member 98 pushing along against the lefthand side-walls of notches N1, N2 and N3. The unlocking of the lock is thus completed.

Rotation of the key in the opposite, locking direction, namely from point (e) to point (d), along slot 124, will cause the extraction of the lock-bolt 12. Additional rotation from (d) to (f), would result in the further movement of lever 92 by the convex portion of notch 78, until the lever is released to jump upwards in the known manner, from its engaging position.

During such rotation, the fixed bits B1', B2' and B3' would bring the tumbler pins P3, P1 and P2 (in that order) back to their aligned positions illustrated in FIGS. 15*a*, 15*b* and 15*c*, which conforms to the starting position of FIG. 10. The key could now be withdrawn from the keyhole by sliding it outwardly along slot 16 (and vacant space 116'). This completes the unlocking and locking procedure of the lock.

As already mentioned, one of the unique features of the present invention is the changeability of the "combination" of the key, namely the relative angular positions of the changeable indexing bits B. In order to effect such change, a technique similar to that employed in dial-combination locks is employed, in the following manner. First, the safe door is opened (in order to obtain access to the cover 20 for inserting the clutch tool through opening 108). Then the lock would be brought once again into the position illustrated in FIG. 11, by rotating the key from point (e) to points (f), (a) and (b). At this stage the clutch releasing tool would be inserted through the openings provided for this purpose, namely, opening 108 provided at the cover 20 of the lock (FIG. 6); opening 74 of disc 48; openings 03, 56, 02, 54 and opening 01, all being aligned at this position of FIG. 11. The clutch release tool (not shown) could be now operated to release tumbler discs 38, 42 and 46 from their respective central portions T1, T2 and T3. The key would then be rotated along guide slots 122 and 126 (from point (b) through (d) to point (f)), thus re-arranging the tumbler pins in a row at their initial 9 o'clock position, without, however, upsetting the positions of notches N1, N2 and N3 which remain arrested by the tool. This step is shown in FIG. 16.

Now the key would be taken out from the lock and the set of bits can be dismounted from the stem 128 after releasing the nut 132 from the front end of the key (FIG. 8). Bits B1, B2 or B3 may now be reinstalled, in a different relative angular position, e.g. rotated by 90, 180 or 270 degrees, (in case of a square stem), or inverted, to achieve other combinations. Of course, the stem 128 may be a polygon of more than four surfaces to enable a larger number of combinations. Furthermore, there may be provided an extra set of such changeable bits, each having a different angular relationship with its profiled central opening, so that any number of combinations, within practicable limitations can be achieved.

After the assembly of all the changeable as-well-as fixed bits in the new order, the key would be inserted to the lock and step (a) to (b) performed, causing the tumbler pins P to adapt themselves to the new combination.

Now the clutch-release-tool would be tightened, establishing the rigid connection between central portions T1, T2 and T3 to their respective tumblers 38, 42 and 46. The tool would be extracted and the lock is ready to be operated by—and only by !—the modified key.

Those skilled in the art to which this invention pertains will readily understand that the invention as herein exemplified and claimed in the appended claims lends itself to many obvious improvements, variations and modifications. Thus, for example, the number of tumbler discs may be one, two, four or more, whether including the key-combination changing means or without such optional feature; the use of the fixed bits for resetting the positions of the tumbler pins may be replaced by suitable means such as spiral return springs, constantly urging the tumbler discs to their initial position; the lock need not necessarily be of the improved type having a self-resettable lever system (with springs 100 and 104); the spacers 40, 44 and 48 may be omitted, and the tumbler discs be rotatably supported by the cylindrical wall of the cavity 22.

These and other changes and modifications should be regarded as included in the scope of the invention as defined in the appended claims.

What is claimed is:

1. A key-operated lock for safe doors and the like comprising a housing; a lock-bolt operable between an unlocked, withdrawn position and a locked, projected position; a lever coupled at one end thereof to the lock-bolt and provided at its other end with an extended control member and with engaging means; a rotatable lever-operating member; a plurality of indexable tumblers mounted in axial alignment with respect to each other, the tumblers being indexable by a key to assume a pre-determined relative position with respect to each other and to said control member; said tumblers comprise an axial central portion defining an opening for receiving a shank of said key, and a peripheral portion having a recessed circumference for receiving said lever control member in said pre-determined relative position of the tumblers; said central and said peripheral portions of each said tumbler are disengageable from each other for adjusting their relative angular positions; each of said central portions of said tumblers is provided with a tumbler projection extending into said opening; said tumblers are rotatably supported by flanged projections of a plurality of fixed plates interposed between adjacent tumblers; said lever being displaceable between operative and non-operative positions controlled by said control member and said tumblers, the arrangement being such that in said operative position, the said tumblers are in said pre-determined relative position and said engaging means are coupled to said lever operating member.

2. The lock as claimed in claim 1 wherein the lever operating member is mounted in axial alignment with said tumblers, and provided with means for coupling the lever operating member to said key.

3. The lock as claimed in claim 2 wherein the lever is spring urged from said non-operative into said operative positions.

4. The lock as claimed in claim 3 wherein the lever at its non-operative position is releasably supported by an arresting member formed at said housing.

5. The lock as claimed in claim 4 wherein said lever engaging means comprise a hook-like position adapted to engage a complementary recessed portion formed at the lower operating member.

6. The lock as claimed in claim 1 wherein said lock housing has a keyhole at a wall thereof in axial alignment with said tumblers for the insertion of said key.

7. The lock as claimed in claim 6 wherein said keyhole includes a fixed projection for guiding the key within the lock.

8. In combination, a lock and a key for operating the lock; the lock comprising a housing; a lock-bolt operable between an unlocked, withdrawn position with respect to the housing and a locked, projected position; a lever coupled at one end thereof to the lock-bolt and provided at its other end with an extended control member and with engaging means; a rotatable lever-operating member; a plurality of indexable tumblers mounted in the housing in axial alignment with respect to each other, the tumblers each including an axial central portion with an opening defined therethrough; the opening of each tumbler being provided with a radial, inwardly projecting pin adapted to be drivingly engaged by the key, the pins being for indexing the tumblers into predetermined relative positions with respect to each other and to the control member; the lever being displaceable between operative and non-operative positions controlled by the control member and the tumblers;

the key comprising an elongate shank, a first set of radially projecting, axially spaced bit members mounted on the key shank at respective angular positions around the shank for rotatively indexing the tumblers into their predetermined positions by drivingly engaging the pins as the key is rotated, and a second set of radially projecting, axially spaced bit members mounted on the key shank for rotatively returning the tumblers into their initial positions, by drivingly engaging the pins as the key is rotated.

9. The combination as claimed in claim 8, wherein the first bit members are at respective different angular positions around the shank.

10. The combination as claimed in claim 8, wherein the tumblers each comprise a peripheral portion having a recessed cicumference for receiving the lever control member in the predetermined relative positions of the tumblers.

11. The combination as claimed in claim 10, wherein the central and peripheral portions of each tumbler are disengageable from each other for adjusting their relative position.

12. The combination as claimed in any one of claims 8, 10 or 11, wherein the key has a first and a second inserted position through the tumblers, wherein at the first inserted position, the first bit members are in position to engage the pins while at the second inserted position, the second bit members are in position to engage the pins.

13. The combination as claimed in claim 11, further comprising a plurality of fixed plates interposed between adjacent tumblers and the tumblers are rotatably supported by flanged projections defined on the plurality of fixed plates.

14. The combination as claimed in either of claims 8 or 11, wherein the bits are attached to rings, the rings being slidably received on the shank, the shank having a polygonal cross-section for mounting the rings at various angular positions with respect to each other.

15. The combination as claimed in claim 14, wherein the first bit members are at respective different angular positions around the shank.

16. The combination as claimed in claim 14, wherein bits of the first set are mounted between bits of the second set.

17. The combination as claimed in claim 12, wherein bits of the first set are mounted between bits of the second set.

18. The combination as claimed in claim 16, wherein the shank has a trailing cylindrical portion provided with guiding slots cooperating with a fixed guiding projection provided at a keyhole formed in the housing.

19. The combination as claimed in claim 18, wherein the guiding slots include:

a first, axially extending section for guiding an insertion of the key so that the bits of the first set become positioned within the openings of the tumblers;

a second circular section for guiding a rotation of the key in the unlocking direction so that the tumblers become positioned in their predetermined position;

the housing including an arresting member for blocking motion of the lever toward the tumblers;

a third, axially extending section of the guiding slot for guiding a further insertion of the key so that the lever becomes released from the arresting member of the housing;

a fourth, axially extending section of the guiding slot for guiding an extraction of the key so that the bits of the second set become positioned within the opening of the tumblers;

a fifth, circular section for guiding a rotation of the key further in the unlocking direction so that the lock-bolt becomes unlocked;

a sixth, circular section for guiding a rotation of the key in the locking direction so that the lock-bolt becomes locked;

a seventh, circular section for guiding a rotation of the key further in the locking direction so that the tumblers become positioned in their initial positions; and an eighth, axially extending section for guiding the extraction of the key from the keyhole.

20. The combination as claimed in claim 19, wherein the first and the eighth sections, and the fifth and sixth sections, respectively, are coinciding.

21. The combination as claimed in claim 20, wherein the third and fourth sections, and the sixth and seventh sections, respectively, are aligned with respect to each other.

22. The combination as claimed in claim 11, wherein said shank has a trailing cylindrical portion provided with guiding slots cooperating with a fixed guiding projection provided at a keyhole formed in the housing, said guiding slots including:

a first, axially extending section for guiding an insertion of the key so that the bits of the first set become positioned within the openings of the tumblers;

a second circular section for guiding a rotation of the key in the unlocking direction so that the tumblers become positioned in said pre-determined position;

a third, axially extending section for guiding a further insertion of the key so that the lever becomes released from said arresting member of the housing;

a fourth, axially extending section for guiding an extraction of the key so that the bits of the second set become positioned within the opening of the tumblers;

a fifth, circular section for guiding a rotation of the key further in the unlocking direction so that the lock-bolt becomes unlocked;

a sixth, circular section for guiding a rotation of the key in the locking direction so that the lock-bolt becomes locked;

a seventh, circular section for guiding a rotation of the key further in the locking direction so that the tumblers become positioned in their initial positions; and an eighth, axially extending section for guiding the extraction of the key from the keyhole.

* * * * *